US005134034A

United States Patent [19]

Makishima et al.

[11] Patent Number: 5,134,034

[45] Date of Patent: Jul. 28, 1992

[54] HEAT TRANSFER MATERIAL

[75] Inventors: Hideo Makishima; Toshihiko Matsushita, both of Tokyo, Japan

[73] Assignee: Mitsubishi Paper Mills Limited, Tokyo, Japan

[21] Appl. No.: 521,546

[22] Filed: May 10, 1990

[30] Foreign Application Priority Data

May 23, 1989 [JP] Japan ..... 1-130676

[51] Int. Cl.[5] ..... B41M 5/26

[52] U.S. Cl. ..... 428/412; 428/195; 428/207; 428/423.1; 428/446; 428/447; 428/473.5; 428/480; 428/484; 428/488.1; 428/500; 428/522; 428/523; 428/913; 428/914

[58] Field of Search ..... 428/195, 207, 484, 488.1, 428/488.4, 913, 914, 412, 423.1, 446, 447, 473.5, 480, 500, 522, 523

[56] References Cited

U.S. PATENT DOCUMENTS 4,732,815 3/1988 Mizobuchi et al. ..... 428/914

*Primary Examiner*—Pamela R. Schwartz

*Attorney, Agent, or Firm*—Wegner, Cantor, Mueller & Player

[57] ABSTRACT

A heat transfer material comprising a substrate, a heat-meltable ink layer provided on one side of the substrate and a heat-resisting layer provided on the other side of the substrate, the heat-meltable ink layer comprising a carbon black as a coloring agent, a wax and a resin, and the ratio of the absorbance at 600 nm to the absorbance of 850 nm measured according to JIS K 0115 being 1.30 or less. The heat transfer material does not substantially cause roll stain and can be detected by a detector using a near infrared ray.

7 Claims, No Drawings

HEAT TRANSFER MATERIAL

BACKGROUND OF THE INVENTION

This invention relates to a heat transfer material. More specifically, this invention relates to a heat transfer material which can be suitably used for a heat transfer printer employed in a ticket vending machine or the like.

Recently, heat transfer printers have been widely used as output units of word processors, facsimile machines, personal computers, duplicating machines, ticket vending machines or the like.

As a heat transfer material for a heat transfer printer, generally used is a material comprising a substrate, a heat-meltable ink layer provided on one side of the substrate and a heat-resisting layer provided on the other side of the substrate.

In the printing system having a heat transfer printer, a printed image is obtained as follows: A heat-meltable ink layer of a heat transfer material is placed in contact with a sheet of plain paper. And then the side of the heat transfer material on which a heat-resisting layer is provided is heated by a thermal head or the like so as to melt the heat-meltable ink layer and transfer the ink to the plain paper.

Heat transfer printers are used as output units for word processors, facsimile machines, personal computers, duplicating machines, ticket vending machines or the like. A ticket vending machine has a mechanism for conveying ticket paper after printing. Many ticket vending machines also have a mechanism for detecting the heat transfer material using a near infrared ray (the above mechanism is hereinafter referred to as "near infrared ray detector").

In the mechanism for conveying ticket paper, necessary pairs of rolls facing with each other rotate and ticket paper is conveyed between the facing rolls. Generally, one of the facing rolls is made of rubber and the other is made of metal. The printed side of the ticket paper generally touches the metal roll.

Since the ticket paper sometimes fails to be conveyed properly when the pressure of the rubber roll on the metal roll is low, relatively high pressure is applied. Thus, the heat-meltable ink on the printed side of the ticket paper is transferred to the metal roll to form stains on the metal roll (hereinafter referred to as "roll stain"). In case of a ticket vending machine in which thousands of pieces of ticket paper are printed in a day, the unprinted portion of the ticket paper is stained on account of roll stain.

It has been found that roll stain can be prevented from occuring by reducing the coating weight of the heat-meltable ink layer. The reason is that most of the heat-meltable ink is soaked into the plain paper when the coating weight is small. When the coating weight is large, a considerable amount of the heat-meltable ink which remains on top of the plain paper, not soaked therein, is transferred to the metal roll to form roll stain.

As described above, roll stain can be prevented from occuring by reducing the coating weight of the heat-meltable ink layer.

However, when the coating weight of the heat-meltable ink layer is reduced, the absorbance of visible rays and the absorbance of near infrared rays are both lowered. If the absorbance of near infrared rays is too low, the heat transfer material cannot be detected by a near infrared ray detector employed in a ticket vending machine.

SUMMARY OF THE INVENTION

It is an object of this invention to provide a heat transfer material which can be suitably used for a heat transfer printer employed in a ticket vending machine or the like. More specifically, the object of this invention is to provide a heat transfer material free from the deficiencies described above, namely occurrence of roll stain and shortage of the absorbance of near infrared rays.

The present inventors have conducted extensive research in order to attain the above object. As a result, it has been found that the object can be attained by using a specific carbon black as a coloring agent contained in the heat-meltable ink layer.

According to this invention, there is provided a heat transfer material comprising a substrate, a heat-meltable ink layer provided on one side of the substrate and a heat-resisting layer provided on the other side of the substrate, the heat-meltable ink layer comprising a carbon black as a coloring agent, a wax and a resin, and the ratio of the absorbance at 600 nm to the absorbance at 850 nm measured according to JIS K 0115 (the above ratio is hereinafter referred to as "absorbance ratio") being 1.30 or less.

The heat transfer material of this invention comprises a specific carbon black in order that the absorbance ratio becomes 1.30 or less. The heat transfer material comprising the specific carbon black hardly causes roll stain, thereby the coating weight of the heat-meltable ink layer can be increased. Therefore, the heat transfer material of this invention has a large absorbance of near infrared rays, and thus can be detected by a near infrared ray detector.

DETAILED DESCRIPTION OF THE INVENTION

This invention will be described in detail below.

The heat transfer material of this invention comprises a substrate, a heat-meltable ink layer provided on one side of the substrate and a heat-resisting layer provided on the other side of the substrate. If necessary, an antistatic layer may be provided between the substrate and the heat-resisting layer or the heat-meltable ink layer.

The heat-meltable ink layer comprises a carbon black as a coloring agent, a wax and a resin.

A carbon black absorbs not only visible rays but also near infrared rays. Near infrared rays are electromagnetic waves having a wavelength of 700–2500 nm; however, generally used for a near infrared ray detector are those having a main wavelength of 800–900 nm. Therefore, the absorbance at 850 nm can be used as a representative of the absorbance of near infrared rays. Visible rays are electromagnetic waves having a wavelength of 400–700 nm; however, the absorbance by a carbon black linearly varies in the above range. Therefore, the absorbance at 600 nm can be used as a representative of the absorbance of visible rays.

Conventionally, heat transfer materials have been required to give a transferred image having a high printing density in a visible region because such an image appears clear. Therefore, there has been used, as the coloring agent, a carbon black having a high absorbance of visible rays such as that of a high color furnace type (hereinafter referred to as "HCF") or that of a medium color furnace type (hereinafter referred to as "MCF"). A heat transfer material comprising such a carbon black has an absorbance ratio of more than 1.30.

In this invention, a specific carbon black is used as the coloring agent contained in the heat-meltable ink layer, whereby the heat transfer material obtained has an absorbance ratio of 1.30 or less. Among carbon blacks for color on the market, that of a regular color furnace type (hereinafter referred to as "RCF") or that of a long flow furnace type (hereinafter referred to as "LFF") can be used in this invention; however RCF is preferred.

The reason why the heat transfer material comprising RCF or LFF hardly causes roll stain is supposed to be as follows: Since both RCF and LFF have a small specific surface area, they hardly adsorb resins, which prevent roll stain from occuring. Moreover, they absorb visible rays in a relatively small amount, and thus are relatively low in apparent blackness. Therefore, such a carbon black is not conspicuous when it adheres to a metal roll.

The wax contained in the heat-meltable ink layer includes paraffin wax, carnauba wax, microcrystalline wax, low molecular weight polyethylene wax, oxidized wax, synthetic wax and the like.

The resin contained in the heat-meltable ink layer includes ethylene-vinyl acetate copolymer, ethylene-ethyl acrylate copolymer, an aliphatic hydrocarbon resin, an aromatic hydrocarbon resin and the like.

In addition to the components mentioned above, if necessary, the heat-meltable ink layer may contain an additive such as a dispersing agent, a dye or a pigment. Especially, a dye or pigment which absorbs near infrared rays can be appropriately used along with the above carbon black.

The coating weight of the heat-meltable ink layer is, preferably 2.0–4.0 g/m$^2$, more preferably 2.5–3.0 g/m$^2$. The more the coating weight, the higher the absorbance of near infrared rays; however the more roll stain occurs.

As the substrate may be used any substrate used for conventional heat transfer materials. Specifically, the substrate includes polyester film, polycarbonate film, polypropylene film, polyimide film, acetate film and the like. The thickness of the substrate is, preferably 3–16 μm, more preferably 4–7 μm.

In this invention, the heat-resisting layer may comprise any heat-resisting substance as an essential component. As the heat-resisting substance may be used, for example, at least one member selected from the group consisting of silicon copolymer, a hydrolyzed product of alkoxysilane, melamine resin, silicon graft copolymer, silicon-functional type silylisocyanate. If necessary, for the purpose of further improvement of the heat resistance, fine particles may be added to the heat-resisting layer to give a rough coat.

DESCRIPTION OF PREFERRED EMBODIMENT OF THE INVENTION

The following Examples further illustrate the invention.

EXAMPLE 1

One side of polyester film with 6 μm thickness was coated with the following coating composition for a heat-resisting layer by a gravure coater and dried at 120° C. for 10 seconds to form a heat-resisting layer having a coating weight of 0.2 g/m$^2$ in terms of solid content.

| Coating composition for a heat-resisting layer | |
|---|---|
| Methylsilyltriisocycanate: | 5 Parts |
| Acid monobutyl phosphate: | 0.2 Part |
| Ethyl acetate: | 94.8 Parts |

The other side of the polyester film was coated with the following coating composition for a heat-meltable ink layer by a hot melt coater to form a heat-meltable ink layer having a coating weight of 2.5 g/m$^2$ in terms of solid coatent. Thus, a heat transfer material of this invention was obtained.

| Coating composition for a heat-meltable ink layer | |
|---|---|
| RCF (a commercially available carbon black): | 14 Parts |
| Paraffin wax: | 58 Parts |
| Ethylene-vinyl acetate copolymer: | 8 Parts |
| Carnauba wax: | 20 Parts |

As to the heat transfer material obtained above, the absorbance at 600 nm ($A_1$) and the absorbance at 850 nm ($A_2$) were measured by a spectrophotometer (mfd. by Hitachi Ltd.) according to JIS K 0115. And then the absorbance ratio ($A_1/A_2$) was calculated.

As a result, the absorbance at 600 nm and the absorbance at 850 nm were 1.50 and 1.29 respectively. Thus, the absorbance ratio was 1.16.

EXAMPLE 2

The same procedure as in Example 1 was repeated, except that the coating weight of the heat-meltable ink layer was 3.0 g/m$^2$.

As a result, the absorbance at 600 nm and the absorbance at 850 nm were 1.80 and 1.54 respectively. Thus, the absorbance ratio was 1.17.

EXAMPLE 3

The same procedure as in Example 1 was repeated, except that LFF (a commercially available carbon black) was used as the carbon black contained in the heat-meltable ink layer.

As a result, the absorbance at 600 nm and the absorbance at 850 nm were 1.71 and 1.31 respectively. Thus, the absorbance ratio was 1.30.

COMPARATIVE EXAMPLE 1

The same procedure as in Example 1 was repeated, except that MCF (a commercially available carbon black) was used as the carbon black contained in the heat-meltable ink layer.

As a result, the absorbance at 600 nm and the absorbance at 850 nm were 1.76 and 1.30 respectively. Thus, the absorbance ratio was 1.35.

COMPARATIVE EXAMPLE 2

The same procedure as in Example 1 was repeated, except that HCF (a commercially available carbon black) was used as the carbon black contained in the heat-meltable ink layer.

As a result,the absorbance at 600 nm and the absorbance at 850 nm were 1.91 and 1.30 respectively. Thus, the absorbance ratio was 1.47.

COMPARATIVE EXAMPLE 3

The same procedure as in Comparative Example 2 was repeated, except that the coating weight of the heat-meltable ink layer was 4.0 g/m$^2$.

As a result, the absorbance at 600 nm and the absorbance at 850 nm were 3.06 and 2.07 respectively. Thus, the absorbance ratio was 1.48.

COMPARATIVE EXAMPLE 4

The same procedure as in Comparative Example 2 was repeated, except that the coating weight of the heat meltable ink layer was 1.9 g/m$^2$.

As a result, the absorbance at 600 nm and the absorbance at 850 nm were 1.45 and 0.99 respectively. Thus, the absorbance ratio was 1.47.

Using the heat transfer materials obtained in Examples 1–3 and Comparative Examples 1–4 above, 8,000 pieces of ticket paper were continuously printed with each heat transfer material by a heat transfer printer provided in a ticket vending machine. And then the heat transfer materials were evaluated as follows:

Roll Stain

After the printing, the metal rolls in the conveying system of the ticket vending machine were observed by the eye.

Detectability

It was seen if a near infrared ray detector provided in the ticket vending machine was able to detect the heat transfer material so that the heat transfer printer properly worked.

Printability

Letters printed on the ticket paper by the heat transfer printer were observed by the eye to see if the printed letters were blurred or not.

The results are shown in the following Table.

TABLE

| | Coating weight of heat-meltable ink layer, g/m$^2$ | Absorbance ratio | Roll stain | Detectability | Printability |
|---|---|---|---|---|---|
| Example 1 | 2.5 | 1.16 | Not observed | Good | Good |
| Example 2 | 3.0 | 1.17 | Not observed | " | " |
| Example 3 | 2.5 | 1.30 | A little observed | " | " |
| Comparative Example 1 | 2.5 | 1.35 | Considerably observed | " | " |
| Comparative Example 2 | 2.5 | 1.47 | Considerably observed | " | " |
| Comparative Example 3 | 4.0 | 1.48 | Remarkably observed | " | " |
| Comparative Example 4 | 1.9 | 1.47 | Not observed | Bad | Bad |

Example 1 did not have any problem. Both printability and detectability were good, and roll stain was not observed.

Example 2, in which the coating weight of the heat-meltable ink layer was 3.0 g/m$^2$ (larger than that of Example 1), did not have any problem either. Both printability and detectability were good, and roll stain was not observed.

Example 3 was able to be used in practice. Both printability and detectability were good though roll stain was a little observed.

Comparative Examples 1 and 2 were not able to be used in practice. Roll stain was considerably observed.

Comparative Example 3, in which the coating weight of the heat-meltable ink layer was larger than that of Comparative Example 2, were not able to be used in practice either. Roll stain was remarkably observed.

Comparative Example 4 was not able to be used in practice either. Both printability and detectability were bad though roll stain was not observed.

What is claimed:

1. A heat transfer material comprising a substrate, a heat-meltable ink layer provided on one side of the substrate and a heat-resisting layer provided on the other side of the substrate, the heat-meltable ink layer comprising a carbon black as a coloring agent, a wax and a resin, and the ratio of the absorbance at 600 nm to the absorbance at 850 nm measured according to JIS K 0115 being 1.30 or less.

2. A heat transfer material according to claim 1, wherein the carbon black is of a regular color furnace type or of a long flow furnace black.

3. A heat transfer material according to claim 1, wherein the carbon black is of a regular color furnace black.

4. A heat transfer material according to claim 1, wherein the wax is paraffin wax, carnauba wax, microcrystalline wax, low molecular weight polyethylene wax, oxidized wax or synthetic wax.

5. A heat transfer material according to claim 1, wherein the resin is ethylene-vinyl acetate copolymer, ethylene-ethyl acrylate copolymer, aliphatic hydrocarbon resin or aromatic hydrocarbon resin.

6. A heat transfer material according to claim 1, wherein the substrate is polyester film, polycarbonate film, polypropylene film, polyimide film or acetate film.

7. A heat transfer material according to claim 1, wherein the heat-resisting layer comprises at least one member selected from the group consisting of silicon copolymer, a hydrolyzed product of alkoxysilane, melamine resin, silicon graft copolymer and silicon-functional silylisocyanate.

* * * * *